US008767988B2

(12) United States Patent
Chen et al.

(10) Patent No.: US 8,767,988 B2
(45) Date of Patent: Jul. 1, 2014

(54) ANALOGIC FRONT CIRCUIT FOR MEDICAL DEVICE

(75) Inventors: Chengying Chen, Beijing (CN); Yong Hei, Beijing (CN); Jun Fan, Beijing (CN); Jianhua Jiang, Beijing (CN)

(73) Assignee: Institute of Microelectronics, Chinese Academy of Sciences, Beijing (CN)

( * ) Notice: Subject to any disclaimer, the term of this patent is extended or adjusted under 35 U.S.C. 154(b) by 0 days.

(21) Appl. No.: 13/697,115

(22) PCT Filed: Jun. 18, 2012

(86) PCT No.: PCT/CN2012/077064

§ 371 (c)(1),
(2), (4) Date: Nov. 9, 2012

(87) PCT Pub. No.: WO2013/159435

PCT Pub. Date: Oct. 31, 2013

(65) Prior Publication Data

US 2013/0287238 A1 Oct. 31, 2013

(30) Foreign Application Priority Data

Apr. 26, 2012 (CN) ..... 2012 1 0126595

(51) Int. Cl.
*H04R 25/00* (2006.01)

(52) U.S. Cl.
USPC ..... 381/321; 381/108; 375/345; 341/126; 341/143

(58) Field of Classification Search
USPC ..... 381/107, 108, 321; 375/345; 455/234.1, 455/240.1, 232.1; 341/126, 143
See application file for complete search history.

(56) References Cited

U.S. PATENT DOCUMENTS 3,517,529 A * 6/1970 Currier ..... 66/41
4,701,958 A * 10/1987 Neth ..... 381/321
5,805,093 A 9/1998 Heikkila et al.
6,868,163 B1 * 3/2005 Goldstein ..... 381/321

(Continued)

FOREIGN PATENT DOCUMENTS

CN 1150507 A 5/1997
CN 1561143 A 1/2005

(Continued)

OTHER PUBLICATIONS

Li, Bingxin et al., "A Second Order Multi-Bit Sigma Delta Modulator with Single-Bit Feedback", Analog Integrated Circuits and Signal Processing, vol. 38, p. 63-72, 2004.*

(Continued)

*Primary Examiner* — Curtis Kuntz
*Assistant Examiner* — Joshua A Kaufman
(74) *Attorney, Agent, or Firm* — Westman, Champlin & Koehler, P.A.

(57) ABSTRACT

An analog front circuit for a medical device includes an automatic gain control loop and a 2-order-3-bit-quantization Sigma-Delta analog-to-digital converter. The automatic gain control loop is configured to implement automatic control of loop gain and output an analog signal to the 2-order-3-bit-quantization Sigma-Delta analog-to-digital converter. The 2-order-3-bit-quantization Sigma-Delta analog-to-digital converter is configured to convert the analog signal output from the automatic gain control loop into a digital code and output the digital code to a DSP for processing.

11 Claims, 5 Drawing Sheets

(56) References Cited

U.S. PATENT DOCUMENTS

| | | | | |
|---|---|---|---|---|
| 7,039,376 | B2 * | 5/2006 | Isoda | 455/232.1 |
| 2002/0067838 | A1 * | 6/2002 | Kindred et al. | 381/104 |
| 2007/0164823 | A1 | 7/2007 | Hsieh et al. | |
| 2009/0302948 | A1 * | 12/2009 | Weigandt et al. | 330/254 |

FOREIGN PATENT DOCUMENTS

| | | | |
|---|---|---|---|
| CN | 101345528 | A | 1/2009 |
| CN | 101426111 | A | 5/2009 |
| CN | 201726531 | U | 4/2011 |

OTHER PUBLICATIONS

International Search Report and Written Opinion dated Jan. 14, 2013 for corresponding International Patent Application No. PCT/CN2012/077064, 9 pages.

First Office Action and Search Report from Chinese Patent Application No. 201210126595.6, dated Dec. 18, 2013.

Sunyoung Kim; Jae-Youl Lee, Seong-Jun Song, et al., "An Energy-Efficient Analog Front-End Circuit for a Sub-1V Digital Hearing Aid Chip," IEEE Solid-State Circuits Society, vol. 4, No. 4, pp. 176-179, Mar. 27, 2006.

* cited by examiner

ANALOGIC FRONT CIRCUIT FOR MEDICAL DEVICE

This application is a National Phase application of, and claims priority to, PCT Application No. PCT/CN2012/077064, filed on Jun. 18, 2012, entitled "ANALOGIC FRONT CIRCUIT FOR MEDICAL HEARING AID DEVICE", which claimed priority to Chinese Application No. 201210126595.6, filed on Apr. 26, 2012. Both the PCT Application and Chinese Application are incorporated herein by reference in their entireties.

TECHNICAL FIELD

The present disclosure relates to the technical field of CMOS analog integrated circuit design. In particular, the present disclosure relates to a low power consumption SOI analog front circuit for a medical device.

BACKGROUND

Silicon-On-Insulator (SOI) CMOS technology is recognized worldwide as "silicon integrated circuit technology of $21^{th}$ century." Due to its unique structure, excellent dielectric isolation between devices, and isolation of silicon under field region by buried oxide layer, the SOI CMOS technology has many advantages compared with conventional bulk-silicon CMOS technology.

The structure and process of the SOI CMOS technology are relatively simple. For bulk-silicon CMOS devices, isolation between devices and isolation between a device and a substrate are implemented by reversely biased PN junctions, which may generate leakage current. Also, the bulk-silicon CMOS device cannot be highly integrated. In contrast, SOI CMOS devices are isolated fully by dielectric structures, and thus field regions and well structures as in the bulk-silicon CMOS circuit are not necessary. As a result, the structure is compact and the process is simpler.

The SOI CMOS technology avoids latch-up effect. The bulk-silicon CMOS technology is based on n-well or p-well. Parasitic "pnpn" structure between the well and the substrate will be activated under certain conditions and cause the latch-up effect. The full dielectric isolation of the SOI terminal avoids the well structure and thus avoids the latch-up effect.

The SOI CMOS technology has good performance at high temperature. The PN junction of the SOI CMOS device is a side junction, which has an effective junction area and a spatial charge region much smaller than that of the bulk-silicon device. As a result, it has better performance at high temperature than the bulk-silicon device under a same heat-induced leakage condition. The SOI device or circuit has three advantages over the bulk-silicon device under a high-temperature operation condition: no heat-activated latch-up effect, small leakage current, and small variation of threshold voltage vs temperature for a thin-film full depletion device.

The SOI CMOS technology has a high speed, a low operation voltage, and a low power consumption. The source-drain junction depth of the SOI device is limited only by the thickness of the top silicon film and thus it is easy to form a shallow junction having a small source/drain area. The parasitic capacitance is small due to the full dielectric isolation.

In summary, the SOI CMOS integrated circuit has small parasitic parameters and substantially no latch-up effect and thus has become a main technology in researching and developing ultra-high scale integrated circuit of high speed, low power consumption, high integration, and high reliability. It is also one of the main technologies for the next generation of system integration with low power consumption and high reliability. Therefore, it has attracted worldwide attention.

In the modern society, more and more people are experiencing inconvenience caused by hearing disorder. According to an authoritative report, about thirty million people all around the world are experiencing the hearing disorder and the population is increasing quickly. Thus, there is a need for a low-cost and high-performance medical device, such as a hearing aid, to alleviate or address various problems caused by the hearing disorder.

Analog front circuit is attracting more and more attention with respect to its structure and design method as the most important module in the input end of the medical hearing aid device. Currently, the medical hearing aid device typically comprises an automatic gain control loop in its analog front circuit. The automatic gain control loop implements feedback using fully customized analog circuits. The analog feedback circuit usually comprises circuit modules such as a peek filter, an analog integrator, an analog comparator, and an analog filter. Such an implementation has advantages in that modules are relatively independent from each other and less interrelated, which may facilitate variation of the circuit. However, the feedback loop is difficult to implement due to limitations of the analog circuit. Meanwhile, it also has disadvantages such as high noise, low control accuracy, and high power consumption. Sigma_delta analog-to-digital converter using single-bit quantization can be used to achieve high accuracy. However, it is usually implemented by high-order integrator and the power consumption is high.

In view of the foregoing, the present disclosure provides an SOI analog front circuit with a novel structure, high performance, and low power consumption for the medical hearing aid device to satisfy the requirement of a digital hearing aid device with high accuracy, low power consumption, and high reliability.

SUMMARY

The present disclosure provides, among other things, an SOI analog front circuit for a medical device, which may solve problems of the analog front circuit in the current medical hearing aid device with respect to noise, accuracy, and power consumption, to achieve advantages such as low noise, high accuracy, and low power consumption.

In view of the foregoing, the present disclosure provides an SOI analog front circuit for a medical device, comprising an automatic gain control loop 10 and a 2-order-3-bit-quantization Sigma-Delta analog-to-digital converter 20, wherein:

the automatic gain control loop 10 is configured to implement automatic control of loop gain and output an analog signal to the 2-order-3-bit-quantization Sigma-Delta analog-to-digital converter 20; and the 2-order-3-bit-quantization Sigma-Delta analog-to-digital converter 20 is configured to convert the analog signal output from the automatic gain control loop into a digital code and output the digital code to a DSP for processing.

The automatic gain control loop 10 may comprise a variable-gain amplifier 100, a fixed-gain amplifier 101, a first buffer and a second buffer (110, 111), a first comparator, a second comparator, and a third comparator (120, 121, 122), and a peak statistics determination logic and gain control logic module (130), wherein:

the variable-gain amplifier 100 in the automatic gain control loop 10 of the analog front circuit may amplify or attenuate an output signal from a microphone and the fixed-gain amplifier 101 may amplify a noise signal;

an analog signal output from the variable-gain amplifier 100 may be buffered by the first buffer 110 and then compared with a peak threshold voltage and an activation threshold voltage by the first comparator and the second comparator (120, 121) to generate a respective 1-bit digital code comparison result, which may be output to the peak statistics determination logic and gain control logic module 130, respectively;

an analog signal output from the fixed-gain amplifier 101 may be buffered by the second buffer 111 and then compared with a noise threshold voltage by a third comparator 122 to generate a 1-bit digital code comparison result, which may be output to the peak statistics determination logic and gain control logic module 130; the peak statistics determination logic and gain control logic module 130 may perform statistics operation and determination on the digital code comparison results output from the first comparator, the second comparator, and the third comparator (120, 121, 122) to generate a 21-bit digital code control signal to the variable-gain amplifier 100 to perform automatic loop gain control.

In the foregoing solution, the variable-gain amplifier 100 may have a close loop structure comprising two stages of full differential operational amplifiers, which implements an adjustable range of a total gain from −6 dB to 54 dB with 21 steps and a step length of 3 dB under control of the peak statistics determination logic and gain control logic module 130. The output signal from the microphone may be amplified or attenuated into an amplitude range between the fixed signal activation threshold voltage (Vact) and the peak threshold voltage (Vpeak).

In the foregoing solution, the fixed-gain amplifier 101 may have a close loop structure comprising two stages of single-end output operational amplifiers. The noise signal may be amplified with a fixed gain of 40 dB. As a result, the weak noise signal may be amplified to meet the accuracy requirement of the following comparators in a mute mode.

In the foregoing solution, the first buffer and the second buffer (110, 111) may buffer the analog signals output from the variable-gain amplifier 100 and fixed-gain amplifier 101, respectively, to reduce influence of feedback noise of the comparators on the signals.

In the foregoing solution, the first comparator, the second comparator, and the third comparator (120, 121, 122) each may have a structure comprising a high-speed dynamic comparator with a pre-amplifier. The first comparator and the second comparator (120, 121) may compare the amplified microphone signal with the peak threshold voltage (Vpeak) and the activation threshold voltage (Vact), respectively. The third comparator 122 may compare the amplified noise signal with the noise threshold voltage (Vnoise). The first comparator, the second comparator and the third comparator (120, 121, 122) each may generate a 1-digital code comparison result and output the same to the peak statistics determination logic and gain control logic module 130. The peak threshold voltage, the activation threshold voltage, and the noise threshold voltage each may have various values configurable by the DSP to enable an optimal signal output range.

In the foregoing solution, the 2-order-3-bit-quantization Sigma-Delta analog-to-digital converter 20 may have a structure characterized by low order and multi-bit quantization. Such a structure achieves a high output signal-to-noise ratio and low power consumption simultaneously. The 2-order-3-bit-quantization Sigma-Delta analog-to-digital converter 20 may comprise a 2-order modulator and a 3-bit quantizer connected in series. The 2-order modulator may comprise two 1-order integrators connected in series. The 3-bit quantizer may be a 3-bit flash ADC.

Compared with prior art, the SOI analog front circuit for the medical device provided by the present disclosure has the following advantages:

1) The present disclosure employs SOI process of low power consumption and high reliability, and whereby reduces the power consumption of the analog front circuit while improving the reliability of the circuit.

2) The analog front circuit for the medical hearing aid device may be implemented by integration of three comparators, an analog-digital hybrid automatic gain control loop and a 2-order-3-bit-quantization Sigma-Delta analog-to-digital converter on a single chip. The analog front circuit has high accuracy, high reliability, and low power consumption. The analog front circuit may be applied in the medical hearing aid device.

3) The detection accuracy requirement of the comparators may be satisfied by amplifying or attenuating the output signal of the microphone by the variable-gain amplifier and amplifying the noise signal by the fixed-gain amplifier.

4) The analog signals from the two amplifiers may each be buffered by a respective buffer and compared with a respective one of the peak threshold voltage, the activation threshold voltage, and the noise threshold voltage by a respective comparator to generate a 3-digital code. The foregoing threshold voltages may be configured by the DSP to enable an optimal signal output range.

5) The peak statistics determination logic and gain control logic module may perform statistics operation and determination on the 3-bit digital code output from the comparators to generate a 21-bit digital code control signal and output the same to the variable-gain amplifier to implement the loop gain control.

6) The 2-order-3-bit bit quantization Sigma-Delta analog-digital converter may comprise a 2-order modulator and a 3-bit quantizer to convert the analog signal output from the automatic gain control loop into a digital code and output the same to the DSP for processing.

DETAILED DESCRIPTION OF EMBODIMENTS

The present disclosure will be further explained in detail in connection with specific embodiments and with reference to the drawings, so that objects, technical solutions and beneficial effects thereof will become more apparent.

Figure 1:
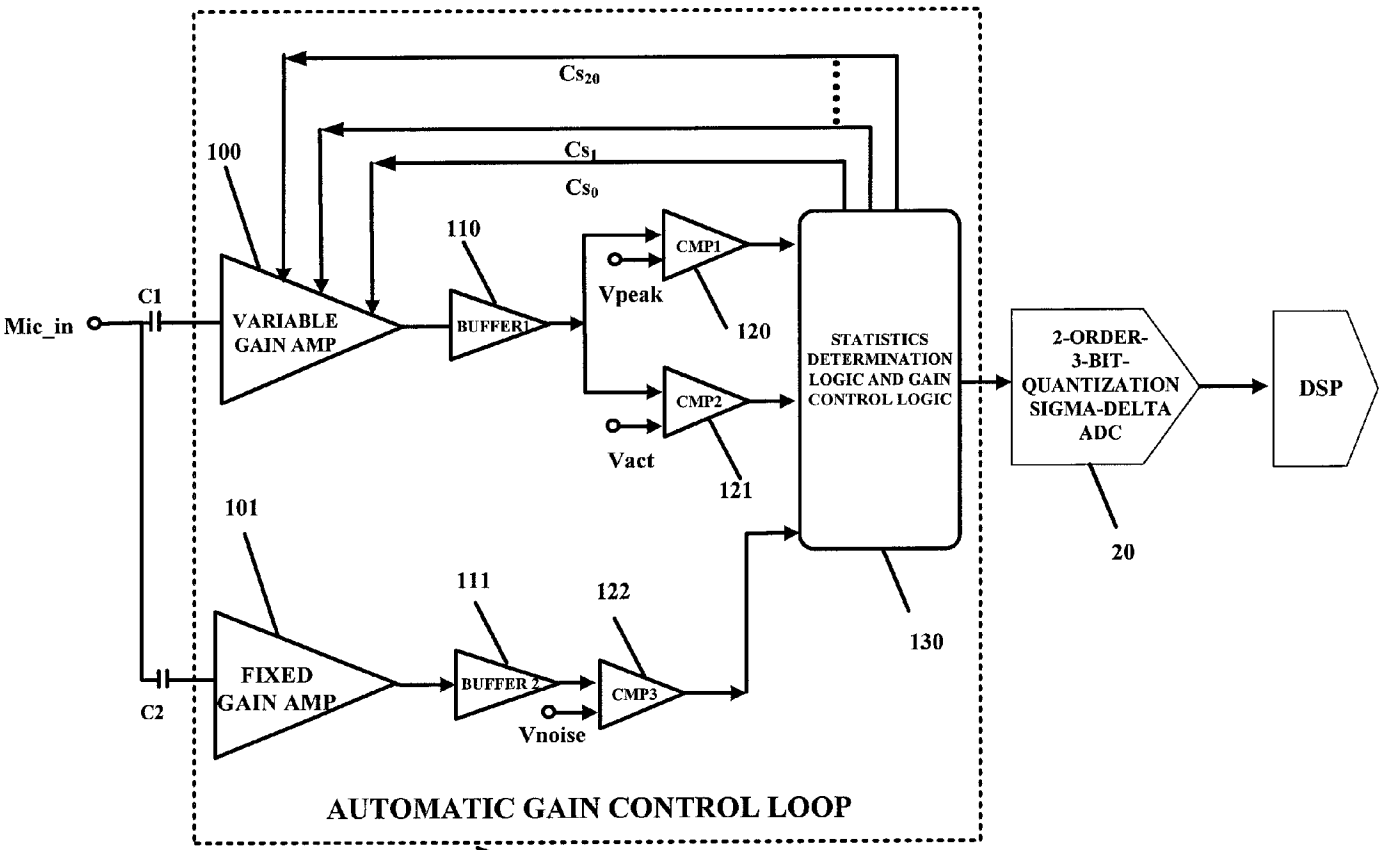
FIG. 1 is a schematic structure diagram of an SOI analog front circuit for a medical device according to an embodiment of the present disclosure.

FIG. 1 is a schematic structure diagram of an SOI analog front circuit for a medical device according to an embodiment of the present disclosure. The analog front circuit comprises an automatic gain control loop 10 with low power consumption and high accuracy and a 2-order-3-bit-quantization Sigma-Delta analog-to-digital converter 20. The automatic gain control loop 10 is configured to implement automatic control of loop gain and output an analog signal to the 2-order-3-bit-quantization Sigma-Delta analog-to-digital converter 20. The 2-order-3-bit-quantization Sigma-Delta analog-to-digital converter 20 is configured to convert the analog signal output from the automatic gain control loop into a digital code and output the digital code to a DSP for processing.

The automatic gain control loop 10 may comprise a variable-gain amplifier 100, a fixed-gain amplifier 101, a first buffer 110, a second buffer 111, a first comparator 120, a second comparator 121, a third comparator 122, and a peak statistics determination logic and gain control logic module 130.

The variable-gain amplifier 100 in the automatic gain control loop 10 of the analog front circuit may amplify or attenuate an output signal from a microphone and the fixed-gain amplifier 101 may amplify noise signal. The variable-gain amplifier 100 may output an analog signal, which may be buffered by the first buffer 110 and then compared with a peak threshold voltage and an activation threshold voltage by the first comparator and the second comparator (120, 121) to generate a respective 1-bit digital code comparison result, respectively. The 1-bit digital code comparison results may be output to the peak statistics determination logic and gain control logic module 130. The fixed-gain amplifier 101 may output an analog signal, which may be buffered by the second buffer 111 and then compared with a noise threshold voltage by the third comparator 122 to generate a 1-bit digital code comparison result. The 1-bit comparison result may be output to the peak statistics determination logic and gain control logic module 130. The peak statistics determination logic and gain control logic module 130 may perform statistics operation and determination on the digital code comparison results output from the first comparator, the second comparator, and the third comparator (120, 121, 122) to generate a 21-bit digital code control signal to the variable-gain amplifier 100 to perform automatic loop gain control.

Figure 2:
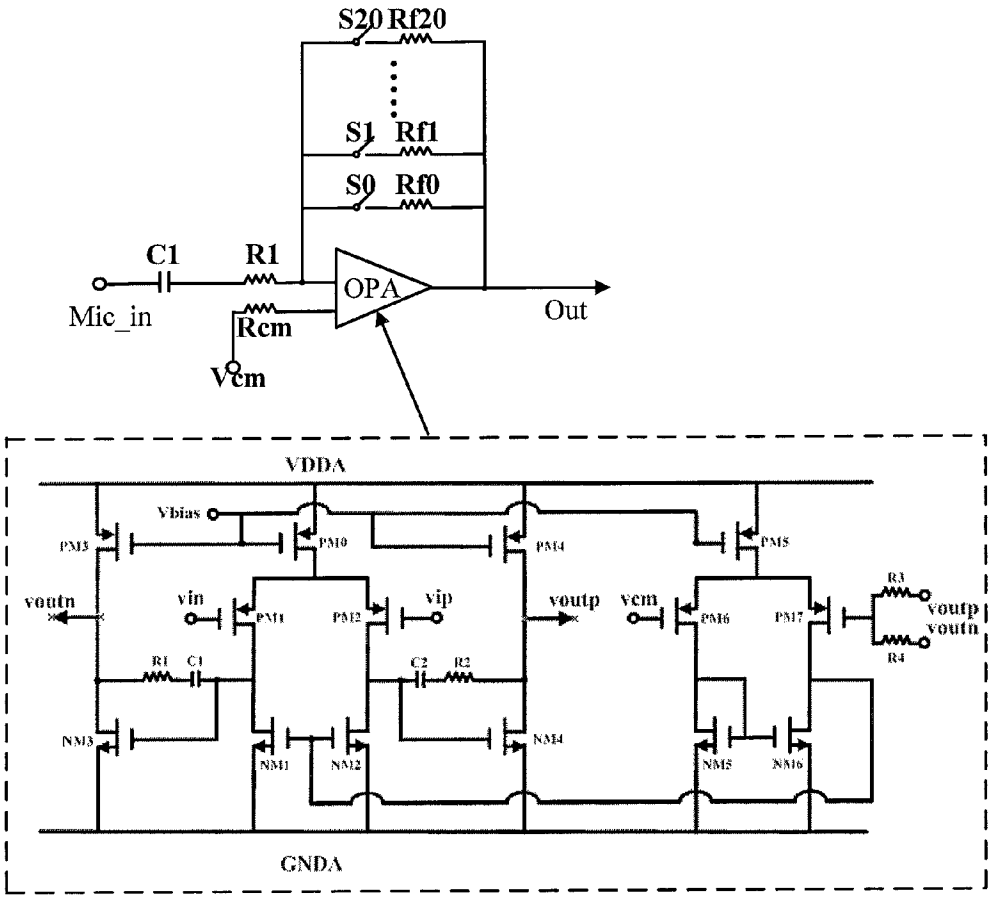
FIG. 2 is a schematic circuit diagram of a variable-gain amplifier in an SOI analog front circuit for a medical device according to an embodiment of the present disclosure.

As shown in FIG. 2, the variable-gain amplifier 100 may have a close loop structure comprising two stages of full differential operational amplifiers, which implements an adjustable range of a total gain from −6 dB to 54 dB with 21 steps and a step length of 3 dB under control of the peak statistics determination logic and gain control logic module 130. The output signal from the microphone may be amplified or attenuated into an amplitude range between the fixed signal activation threshold voltage (Vact) and the peak threshold voltage (Vpeak). The close loop structure comprising two stages of full differential operational amplifiers may comprise a main operational amplifier and a common mode feedback operational amplifier. The main operational amplifier may comprise a first stage including transistors PM0, PM1, PM2, NM1, and NM2, and a second stage including transistors PM3, PM4, NM3, and NM4. Capacitors C1 and C2 and resistors R1 and R2 constitute Miller compensation to guarantee sufficient phase margin of the two stages of operational amplifiers. The common mode feedback operational amplifier may comprise transistors PM5, PM6, PM7, NM5, and NM6, and resistors R3 and R4. The common mode feedback operational amplifier detects an output common mode level and compares the same with a common mode voltage Vcm to detect an error. The detected error is fed back to respective gates of the transistors NM1 and NM2 to stabilize the common mode output voltage.

Figure 3:
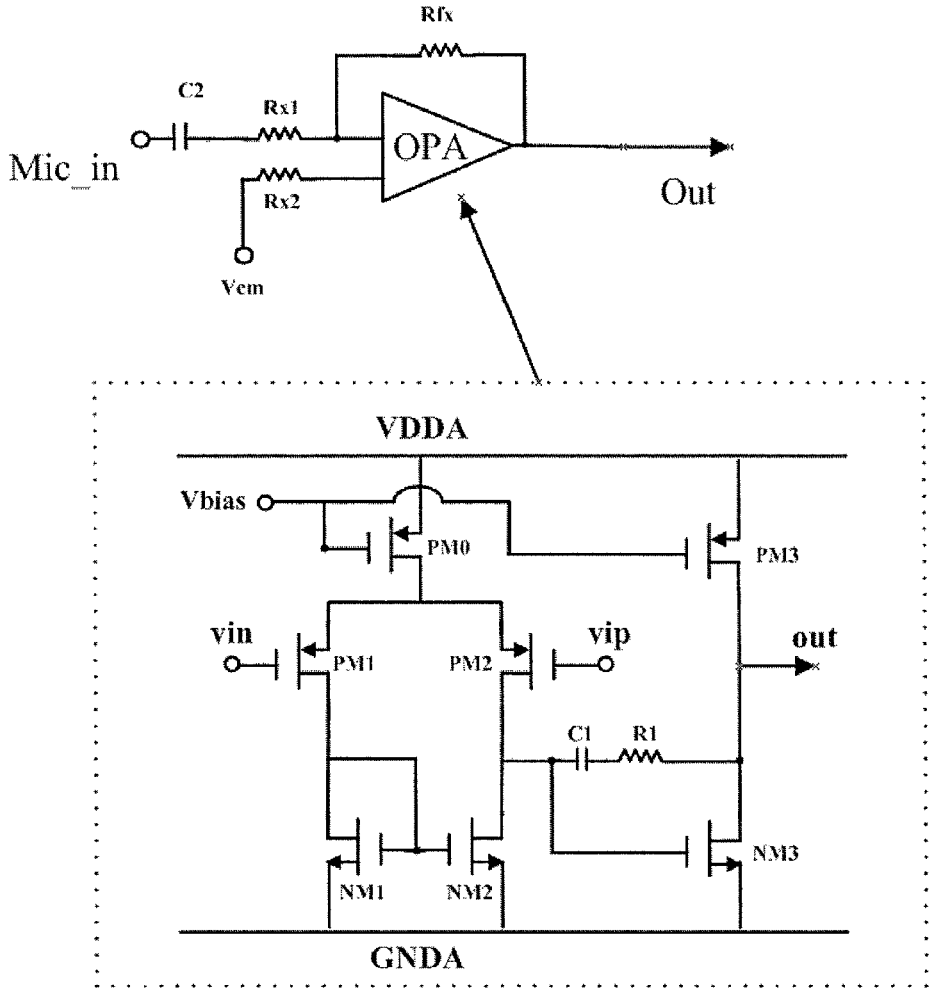
FIG. 3 is a schematic circuit diagram of a fixed-gain amplifier in an SOI analog front circuit for a medical device according to an embodiment of the present disclosure.

As shown in FIG. 3, acoustic signal typically has an amplitude of only about 0.4 mV and noise signal typically has an amplitude of only less than 0.1 mV, while comparison accuracy of a common comparator is typically about 0.5 mV. Thus in a mute mode, the noise signal needs to be pre-amplified with a certain gain to match the accuracy requirement of the comparator. The fixed-gain amplifier 101 may have a close loop structure comprising two stages of single-end output operational amplifiers. The noise signal may be amplified with a fixed gain of 40 dB. As a result, the weak noise signal may be amplified to meet the accuracy requirement of the following comparator in the mute mode. The close loop structure comprising two stages of single-end output operational amplifiers may comprise a first stage including transistors PM0, PM1, PM2, NM1, and NM2, and a second stage including transistors PM3 and NM3. Capacitors C1 and C2 constitute Miller compensation to guarantee sufficient phase margin of the two stages of operational amplifiers.

Figure 4:
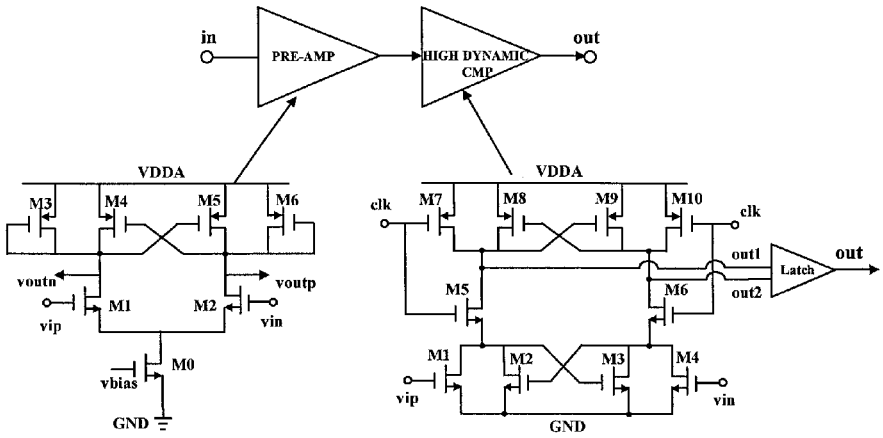
FIG. 4 is a schematic circuit diagram of a comparator in an SOI analog front circuit for a medical device according to an embodiment of the present disclosure.

As shown in FIG. 4, the first comparator, the second comparator and the third comparator (120, 121, 122) each may have a structure comprising a high-speed dynamic comparator with a pre-amplifier. A latch is arranged at the output end to latch the output level. The pre-amplifier comprises PMOS transistors M3 and M6 each connected in a diode mode as load. The cross-coupled transistors M4 and M5 introduce weak positive feedback to increase the gain of the amplifier. A trail current source M0 is biased by a bias voltage Vbias. The pre-amplifier may have a gain of about 10 times to cooperate with the high-speed dynamic comparator. The high-speed dynamic comparator may comprise a clocked high-speed positive feedback dynamic comparator with low power consumption. In particular, the high-speed dynamic comparator may comprise a cross-coupled circuit including PMOS transistors M7, M8, M9, and M10 and a cross-coupled circuit including NMOS transistors M1, M2, M3, and M4. When the clock clk is LOW, output terminals out1 and out2 are both pulled to HIGH. As a result, the comparator is in a pre-charge state and the positive feedback is disabled. When the clock clk is HIGH, if vin>vip, the output terminal out2 is pulled to LOW quickly by the cross-coupled PMOS transistors M7 and M9 and NMOS transistors M3 and M4. However, the output terminal out1 remains HIGH. As a result, the output terminal out2 is '0' while the output terminal out1 is '1'. In contrast, if vin<vip, the output terminal out2 is '1' while the output terminal out1 is '0'. In this way, comparison function is performed. Such a comparator has a compact structure, low power consumption, and small area. The latch converts the differential output into single-ended and latches the same. The first comparator and the second comparator (120, 121) compare the amplified microphone signal with the peak threshold voltage (Vpeak) and activation threshold voltage (Vact), respectively. The third comparator 122 compares the amplified noise signal with a noise threshold voltage (Vnoise). The first comparator, the second comparator, and the third comparator each generate a 1-bit digital code comparison result and output the same to the peak statistics determination logic and gain control logic module 130. The peak threshold voltage, the activation threshold voltage, and the noise threshold voltage each may have various values that can be configured by the DSP to achieve an optimal signal output range.

Because the acoustic signal is continuously changed, the peak statistics determination logic and gain control logic module 130 performs statistics operation on the acoustic signal for a period of time and makes determination based upon the statistics characteristics of the signal to generate and output the gain control signal. According to the present disclosure, the peak statistics determination logic and gain control logic module 130 performs statistics operation and determination on the digital code comparison results output from the first comparator, the second comparator, and the third comparator (120, 121, 122) every 600 clock cycles of the comparator, based on the characteristics of the acoustic signal. The peak statistics determination logic and gain control logic module 130 outputs a 21-bit digital code control signal to the variable-gain amplifier 100 to increase or decrease its gain, so as to implement the automatic loop gain control. This part of circuitry may be implemented by digital circuit.

Figure 5:
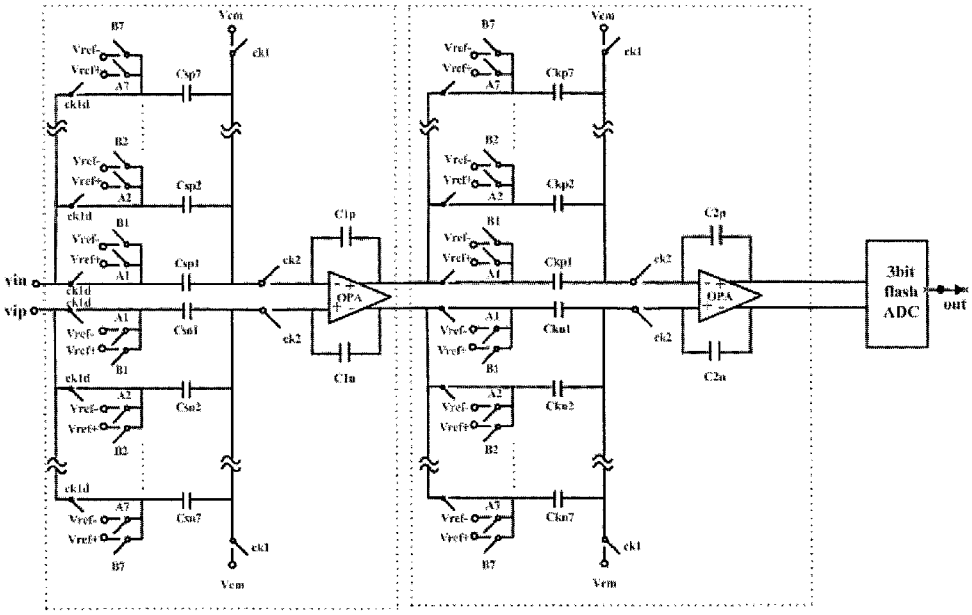
FIG. 5 is a schematic circuit diagram of a 2-order-3-bit-quantization Sigma-Delta analog-to-digital converter in an SOI analog front circuit for a medical device according to an embodiment of the present disclosure.

As shown in FIG. 5, the 2-order-3-bit Sigma-Delta digital-to-analog converter converts the analog signal output from the automatic gain control loop into a digital code and outputs the same to the DSP for processing. The 2-order-3-bit Sigma-Delta digital-to-analog converter comprises a 2-order modulator and a 3-bit quantizer connected in series. The 2-order modulator comprises two 1-order integrators connected in series. The integrators each perform sampling and integration on input signal under control of a two-phase non-overlapped clock. During the sampling phase, switches ck1 and ck1*d* are closed while switch ck2 is opened. The input signal is sampled by capacitors Csp1 . . . Csp7 and Csn1 . . . Csn7. During the integration phase, the switch ck2 are closed while switches ck1 and ck1*d* are opened. One of reference voltages vref+ and vref− is selected according to a feedback signal from the quantizer. Charges corresponding to the sampled signal on the capacitors Csp1 . . . Csp7 and Csn1 . . . Csn7 are transferred to integration capacitor Ckp1 . . . Ckp7 and Ckn1 . . . Ckn7 to perform Sigma-Delta modulation of the input analog signal. The integrator has a two-stage operational amplifier structure similar to that of the variable-gain amplifier. The 3-bit quantizer is a 3-bit flash ADC comprising three high-dynamic comparators each having a structure similar to that shown in FIG. 4. The analog signal after being sampled and integrated is compared with the reference level to generate and output a 3-bit digital code. Such a low-order multi-bit quantization structure achieves a high output signal-to-noise ratio up to more than 80 dB and low power consumption simultaneously.

Figure 6:
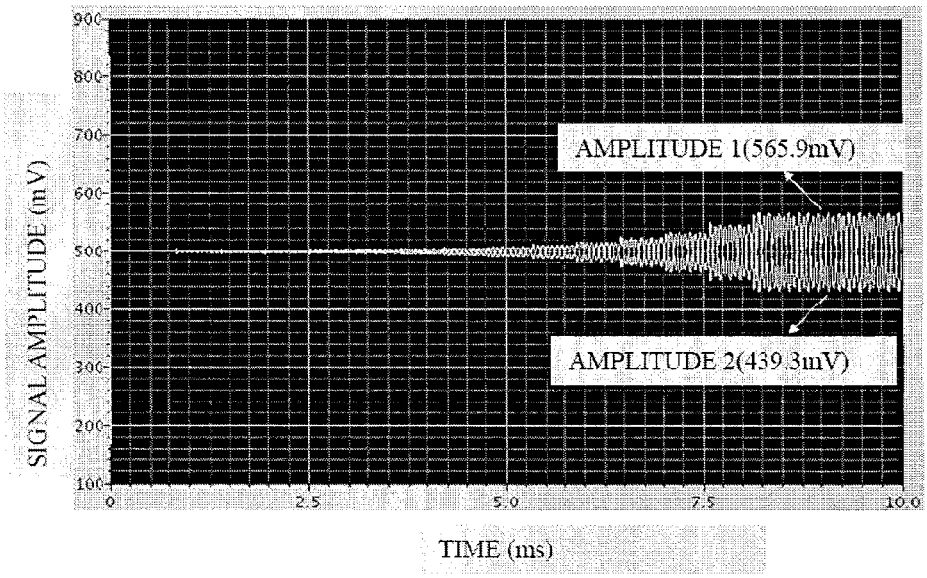
FIG. 6 shows an output result of an automatic gain control loop in an SOI analog front circuit for a medical device according to an embodiment of the present disclosure with an input signal having an amplitude of 1 mV and frequency of 10 KHz.

According to an embodiment, the DSP sets the peak threshold voltage (Vpeak=250 mV), the activation threshold voltage (Vact=90 mV), and the noise threshold voltage (Vnoise=6 mV). FIG. 6 shows an output result of the automatic gain control loop when the input signal has an amplitude of 1 mV and a frequency of 10 KHz. The output signal is compared with the peak threshold voltage (Vpeak) and the activation threshold voltage (Vact) at the end of each cycle. If the output signal is lower than the activation threshold voltage (Vact), the signal is increased by 3 dB until the output signal is higher than the activation threshold voltage (Vact=90 mV). Because the amplitude of the input signal (1 mV) is far lower than the activation threshold voltage (Vact), the output signal is increased by 3 dB in each cycle and is fixed at 126.6 mV after 14 cycles.

Figure 7:
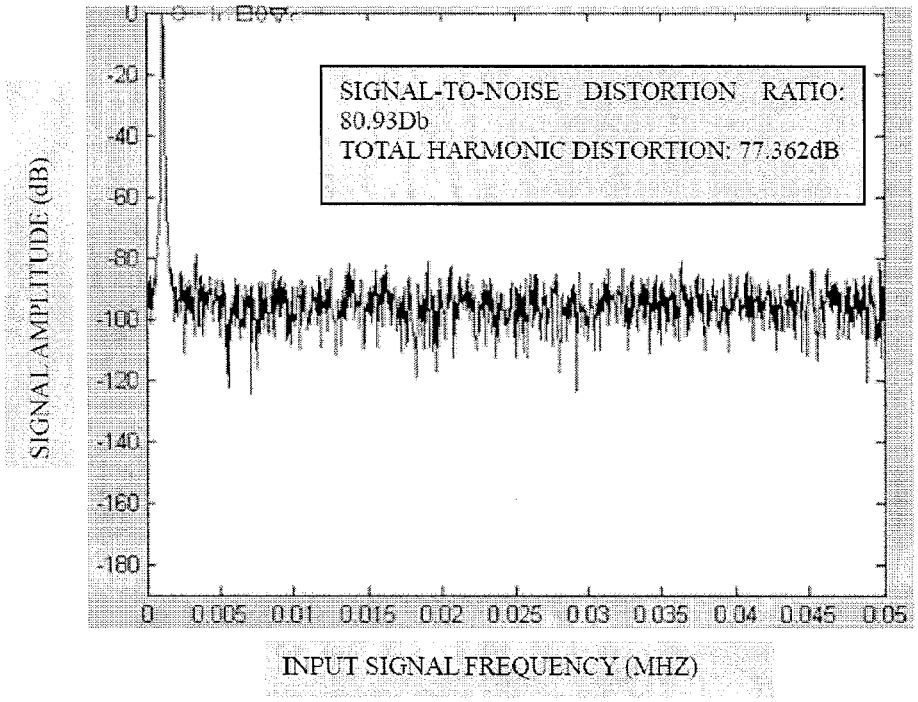
FIG. 7 shows a frequency spectrum analysis result of an output signal from an SOI analog front circuit for a medical device according to an embodiment of the present disclosure with an input signal having an amplitude of 1 mV and frequency of 10 KHz.

FIG. 7 shows a frequency spectrum analysis result of Fourier Transformation of a sampled time-domain signal output from the analog front circuit when the input signal has an amplitude of 1 mV and a frequency of 10 KHz. As shown in FIG. 7, the output signal-to-noise ratio is above 80 dB, indicating that the embodiment according to the present disclosure exhibits a good performance.

In summary, according to the present disclosure, there is provided an SOI analog front circuit for the medical device implemented by integration of three comparators, an analog-digital hybrid automatic gain control loop and a 2-order-3-bit-quantization Sigma-Delta analog-to-digital converter on a single chip. In the analog front circuit, the output signal from the microphone is first amplified or attenuated by the variable-gain amplifier in the automatic gain control loop and the noise signal is amplified by the fixed-gain amplifier. Analog signals output from the two amplifiers are buffered by respective buffers and compared with a respective one of the peak threshold voltage, the activation threshold voltage, and the noise threshold voltage by a respective comparator to generate a 3-digital code. The peak statistics determination logic and gain control logic module generates a 21-bit digital code control signal and outputs the same to the variable-gain amplifier to implement the loop gain control. The 2-order-3-bit bit quantization Sigma-Delta analog-digital converter converts the analog signal into a digital code and outputs the same to the DSP for processing. The SOI analog front circuit has high accuracy, high reliability and low power consumption. The SOI analog front circuit may be applied in the medical hearing aid device.

The objects, technical solutions and beneficial effects of the present disclosure have been further explained in detail in connection with the above specific embodiments. It should be understood that all of the above are only specific embodiments of the present disclosure but do not constitute a restriction to the present disclosure. For example, the analog front circuit as described above may be implemented by either SOI or bulk-silicon process. Any modification, equivalent substitution, and improvement, etc., within the spirit and principle of the present disclosure should be included in the scope of the present disclosure.

What is claimed is:

1. An analog front circuit for a medical device, comprising an automatic gain control loop (10) and a 2-order-3-bit-quantization Sigma-Delta analog-to-digital converter (20), wherein:

the automatic gain control loop (10) is configured to implement automatic control of loop gain and output an analog signal to the 2-order-3-bit-quantization Sigma-Delta analog-to-digital converter (20);

the 2-order-3-bit-quantization Sigma-Delta analog-to-digital converter (20) is configured to convert the analog signal output from the automatic gain control loop into a digital code and output the digital code to a DSP for processing; and the automatic gain control loop (10) comprises a variable-gain amplifier (100), a fixed-gain amplifier (101), a first buffer and a second buffer (110, 111), a first comparator, a second comparator, and a third comparator (120, 121, 122), and a peak statistics determination logic and gain control logic module (130), wherein:

the variable-gain amplifier (100) in the automatic gain control loop (10) of the analog front circuit amplifies or attenuates an output signal from a microphone and the fixed-gain amplifier (101) amplifies a noise signal;

an analog signal output from the variable-gain amplifier (100) is buffered by the first buffer (110) and then compared with a peak threshold voltage and an activation threshold voltage by the first comparator and the second comparator (120,121), respectively, to generate a respective 1-bit digital code comparison result, which is output to the peak statistics determination logic and gain control logic module (130);

an analog signal output from the fixed-gain amplifier (101) is buffered by the second buffer (111) and then compared with a noise threshold voltage by a third comparator (122) to generate a 1-bit digital code comparison result, which is output to the peak statistics determination logic and gain control logic module (130); and the peak statistics determination logic and gain control logic module (130) performs statistics operation and determination on the digital code comparator results output from the first comparator, the second comparator, and the third comparator (120, 121, 122) to output a 21-bit digital code control signal to the variable-gain amplifier (100) to perform automatic loop gain control.

2. The analog front circuit for the medical device according to claim 1, characterized in that:

the variable-gain amplifier (100) has a close loop structure comprising two stages of full differential operational amplifiers, which implements an adjustable range of a total gain from −6 dB to 54 dB with 21 steps and a step length of 3 dB under control of the peak statistics determination logic and gain control logic module (130); and an output signal from the microphone is amplified or attenuated by the variable-gain amplifier (100) into an amplitude range between a fixed signal activation threshold voltage (Vact) and a peak threshold voltage (Vpeak).

3. The analog front circuit for the medical device according to claim 1, characterized in that:

the fixed-gain amplifier (101) has a close loop structure comprising two stages of single-end output operational amplifiers; and the fixed-gain amplifier (101) amplifies the noise signal with a fixed gain of 40 dB, so that the weak noise signal is amplified to meet the accuracy requirement of the following comparator in a mute mode.

4. The analog front circuit for the medical device according to claim 1, characterized in that:

the first buffer and the second buffer (110, 111) buffer the respective analog signals output from the variable-gain amplifier (100) and the fixed-gain amplifier (101), respectively, to reduce influence of feedback noise of the comparators on these signals.

5. The analog front circuit for the medical device according to claim 1, characterized in that:

the first comparator, the second comparator, and the third comparator (120, 121, 122) each has a structure comprising a high-speed dynamic comparator with a pre-amplifier.

6. The analog front circuit for the medical device according to claim 5, characterized in that:

the first comparator and the second comparator (120, 121) compare the amplified microphone signal with the peak threshold voltage (Vpeak) and the activation threshold voltage (Vact), respectively;

the third comparator (122) compares the amplified noise signal with the noise threshold voltage (Vnoise); and the first comparator, the second comparator and the third comparator (120, 121, 122) each generates the 1-digital code comparison result and output the same to the peak statistics determination logic and gain control logic module (130).

7. The analog front circuit for the medical device according to claim 6, characterized in that:

the peak threshold voltage, the activation threshold voltage, and the noise threshold voltage each has various values configurable by the DSP to enable an optimal signal output range.

8. The analog front circuit for the medical device according to claim 1, characterized in that:

the 2-order-3-bit-quantization Sigma-Delta analog-to-digital converter 20 has a structure characterized by low order and multi-bit quantization.

9. The analog front circuit for the medical device according to claim 8, characterized in that:

the 2-order-3-bit-quantization Sigma-Delta analog-to-digital converter (20) comprises a 2-order modulator and a 3-bit quantizer connected in series;

the 2-order modulator comprises two 1-order integrators connected in series; and the 3-bit quantizer is a 3-bit flash ADC.

10. The analog front circuit for the medical device according to claim 8, characterized in that the analog front circuit for the medical device is implemented in bulk-silicon.

11. The analog front circuit for the medical device according to claim 8, characterized in that the analog front circuit for the medical device is implemented in SOI.

* * * * *